United States Patent [19]

Getzen

[11] Patent Number: 4,754,682

[45] Date of Patent: Jul. 5, 1988

[54] CLARINET TUNING BARREL

[76] Inventor: Donald E. Getzen, 15 Lake View Dr., Lake Geneva, Wis. 53147

[21] Appl. No.: 66,144

[22] Filed: Jun. 25, 1987

[51] Int. Cl.[4] ..... G10D 7/06
[52] U.S. Cl. ..... 84/382; 84/386
[58] Field of Search ..... 84/380–386

[56] References Cited

U.S. PATENT DOCUMENTS 4,219,937 9/1980 Lorenzini ..... 33/178 B
4,258,605 3/1981 Lorenzini ..... 84/382

FOREIGN PATENT DOCUMENTS 2030752 4/1980 United Kingdom ..... 84/382

*Primary Examiner*—Lawrence R. Franklin
*Attorney, Agent, or Firm*—Peter N. Jansson, Ltd.

[57] ABSTRACT

An improved clarinet tuning barrel (10). The tuning barrel is a thermally-conductive tubular member having a plurality of grooves (36) in the outer wall (24) over most of its length. The grooves preferably extend around the tubular member, are annular, parallel and most preferably closely and substantially equally spaced. The grooves are preferably quite deep. The tuning barrel is preferably a unitary piece of lightweight aluminum alloy.

18 Claims, 2 Drawing Sheets

CLARINET TUNING BARREL

FIELD OF THE INVENTION

This invention is related generally to clarinets and, more particularly, to clarinet tuning barrels of the type removably joinable at their opposite ends to mouthpieces and clarinet bodies.

BACKGROUND OF THE INVENTION

Clarinet tuning barrels, that is, the tubular devices which are each connected between a mouthpiece and a clarinet body and form part of a clarinet, are commonly employed for slightly changing the pitch of a clarinet when tuning becomes necessary. A clarinet tuning barrel of this general type typically has an upper end portion joinable to a mouthpiece, a lower end portion joinable to a clarinet body, and a central portion therebetween.

A continuous bore extends through the upper, central and lower portions and forms part of the principal air passageway within the clarinet. The bore includes upper, central and lower cylindrical bores, such bores extending in series through the upper, central and lower portions of the tuning barrel.

The upper and lower bores typically have greater diameters than the central bore, allowing them to slidably receive and frictionally engage male portions of the mouthpiece and clarinet body, respectively. One or both of these interconnections can be adjusted slightly to extend or shorten the length of the clarinet. This action serves to slightly change the clarinet pitch, that is, to tune the clarinet.

Clarinets and clarinet tuning barrels are typically made of wood or plastic, although some clarinets have been of metal. Clarinet tuning barrels often have metal edge rings along the wooden or plastic lips at one or both of the ends.

Tuning barrels have a very significant effect on the performance of a clarinet, quite beyond their ability to tune the instrument. The position of the tuning barrel, immediately adjacent to the mouthpiece, accounts for this significant effect. The flow of air, as soon as it passes the mouthpiece, will both affect the tuning barrel and be affected by the tuning barrel.

Exhaled air is typically warm compared to ambient air and this can have an effect on the tuning barrel. This in turn has an effect on clarinet tone. Any irregularities or imperfections in the bore of the tuning barrel can cause eddies and irregularities in air flow which will continue and/or enlarge as the air continues through the clarinet. This also has an effect on clarinet tone.

Therefore, problems and imperfections in clarinet tuning barrels can have a substantial negative impact on the performance of the clarinets on which they are used, whether they be expensive, professional-quality clarinets or relatively inexpensive student clarinets. Likewise, improvements in tuning barrels can provide substantial performance improvements for the clarinets on which they are used, regardless of quality.

Over the long history of the clarinet, there have been various improvements in clarinet tuning barrels. However, it is quite clear that there are still many problems and deficiencies:

Problems with clarinet performance often relate to problems with the material and/or structure of the tuning barrel, and to questions of heat and/or moisture.

Tonal qualities are often deficient due to variations and imperfections on the inside surface of the tuning barrel.

Wooden tuning barrels undergo swelling and shrinkage during the changing temperature and humidity conditions of changing seasons. In addition, placement of a clarinet, either in or out of its case, on or near a heating duct or radiator or for prolonged periods in the sunlight can cause drying and shrinkage which will then be interrupted by periods of relative swelling. Such swelling and shrinkage can perceptibly affect intonation. Such swelling and shrinkage over time also can cause imperfections in the bore, which themselves can perceptibly erode tonal quality.

Some of the problems mentioned above with respect to wooden tuning barrels are applicable to plastic tuning barrels as well. In addition, plastic tuning barrels have certain problems unique to themselves.

Sometimes plastic tuning barrels have or develop waviness or undulations on the inside surfaces of their bores due to plastic shrinkage or distortion. This most typically can occur immediately after a molding step, and can be severe, particularly if there is no subsequent bore machining step. Such imperfections, of course, affect tonal quality.

One very specific problem with clarinet tuning barrels of the prior art relates to the tendency of the metal rings at their ends to loosen and fall off. This is frequently caused by the distortive effects of heat, cold, moisture and/or dryness. Such loosening of rings often is accompanied by or results in cracked wood or chipped or cracked plastic which is, of course, deleterious to the tuning barrel and to clarinet performance.

The problems of heat and cold, in addition to affecting the long-term quality of tuning barrels, can have a more transitory effect related to the clarinet pitch. If the instrument is too hot or cold, there is a tendency for it to be off-tone. This problem is not dependent on the type of material, although materials less able to dissipate or absorb heat are more susceptible to such problems.

If an instrument becomes too warm, it has a tendency to become sharper, that is, too high in pitch, to a slight extent. During any normal playing, exhaled air by the clarinet player tends to heat the clarinet including the tuning barrel, and if such heat is not dissipated, slight imperfection in tone can result. Even during playing of a clarinet, the musician's relatively warm breath can have a heating effect on the tuning barrel, and it is desirable for such heat to dissipate quickly to maintain the barrel at a reasonable temperature.

When clarinets are exposed for long periods of time to very cold temperatures, as they often are during transport in the winter or in certain outdoor performances, they may have a tendency to be perceptibly flatter, that is, lower in pitch. Avoidance of extreme temperatures is desirable, but tuning barrels of the prior art tend not dissipate or absorb heat very quickly.

There is a significant need for improved clarinet tuning barrels.

OBJECTS OF THE INVENTION

It is an object of this invention to provide an improved clarinet tuning barrel overcoming some of the problems and shortcomings of the prior art.

Another object of this invention is to provide a clarinet tuning barrel giving excellent performance despite changing temperature and humidity conditions.

Another object of this invention is to provide a clarinet tuning barrel which is not susceptible to damage from changing temperature or humidity conditions over long periods.

Another object of this invention is to provide a clarinet tuning barrel capable of more quickly adjusting to thermal variations to avoid or minimize certain transitory effects of heat and cold.

Another object of this invention is to provide a tuning barrel which will help maintain consistent clarinet intonation in all temperature conditions.

Another object of this invention is to provide a clarinet tuning barrel which will greatly reduce or eliminate expansion and contraction concerns.

Another object of this invention is to provide a clarinet tuning barrel in which the bore can remain substantially constant and uninterrupted over long periods.

These and other important objects will be apparent from the descriptions of this invention which follow.

SUMMARY OF THE INVENTION

This invention is an improved clarinet tuning barrel overcoming certain problems and shortcomings of prior clarinet tuning barrels, including those mentioned above. The tuning barrel of this invention is generally of the type having upper and lower end portions joinable to a mouthpiece and a clarinet body, respectively, a central portion between the upper and lower portions, and, of course, inner and outer walls.

The improved tuning barrel of this invention is a thermally-conductive tubular member which has a plurality of grooves in the outer wall on all of its major portions, that is, its upper, central and lower portions. The grooves preferably extend around the tubular member. Most preferably, such grooves are annular and parallel.

In certain preferred embodiments, the clarinet tuning barrel of this invention has annular grooves which are substantially equally spaced. The spacing between grooves in such embodiments preferably approximates the widths of the grooves, such that the grooving is a dominant feature of the outside wall.

The grooves preferably are quite deep, having depths substantially greater than half the wall thickness of the tubular member at positions adjacent to such grooves. Such deep grooving is believed to have a number of significant advantages, including: reducing the weight of the tuning barrel by elimination of bulk; enhancing heat exchange characteristics; and, it is believed, at the same time enhancing tonal qualities.

The grooves are preferably made as deep as reasonably possible given certain structural requirements of tuning barrels. For example, the inner wall of the tuning barrel forms, along the upper, central and lower portions of the barrel, upper, central and lower cylindrical bores in series, the central bore having a diameter less than the diameters of the upper and lower bores. The larger inner wall diameters of the upper and lower portions are made to accommodate insertion of a mouthpiece and a clarinet body. In such embodiments, the grooves along the central portion preferably extend radially inwardly to positions radially inside of the radial position of the inner wall along the upper and lower bores.

In all preferred embodiments of this invention, the tuning barrels are unitary pieces, each integrally-formed of a thermally-conductive material. Integral construction eliminates any concerns about loosening of parts such as occurs in certain prior tuning barrels.

As used herein, "thermally-conductive" refers to materials such as metals, which are known for their thermal conductivity, and excludes materials such as woods or plastics having low thermal conductivity. Highly preferred thermally-conductive materials for use in this invention are lightweight aluminum alloys in which aluminum is the primary constituent.

In certain highly preferred embodiments, the aluminum alloy includes one or more other metals having densities substantially greater than that of aluminum, preferably at least about 5% of said other metals. Most preferably, the alloy includes about 5% copper.

Applicant has found that such aluminum alloys, at least in tuning barrels having the structural features described above, produce sounds of much better tonal quality than are produced in a tuning barrel of pure aluminum. More specifically, pure aluminum produces much too "bright" a sound, while such alloys produce a richer, more opulent tone. While not wanting to be bound by any theoretical considerations, applicant believes that such alloys in some manner damp the natural vibrations of the aluminum to provide the richer tonal qualities.

The use of such lightweight aluminum alloys and the aforementioned deeply grooved barrel configuration produce a tuning barrel having a weight approximating the weight of a wooden or plastic clarinet tuning barrel of standard design. This allows provision of the major advantages of this invention without the imbalance which would attend a much heavier metal tuning barrel.

A variety of expansion and contraction concerns associated with prior tuning barrels are eliminated or greatly reduced in the clarinet tuning barrel of this invention. Both long-term and short-term concerns are alleviated.

Among the advantages of the improved clarinet tuning barrel of this invention is that, because of the nature of the material from which it is made, the bore can be machined and formed to near perfection, without any of the aforementioned changes, irregularities and imperfections of the wood and plastic commonly used. The machining of the bore in the clarinet tuning barrel of this invention will provide a very accurate bore which is substantially immune to change, both during the manufacturing steps and over extended periods. Thus, a tuning barrel is produced having reliable high-quality performance.

Yet another advantage relates to the unitary nature of the tuning barrel of this invention and to its dimensional stability, despite long-term temperature and humidity variations. With this invention, any concerns about loose end rings are obviated. End rings are not used and would serve no purpose.

An important advantage relates to the heat absorbing and dissipating characteristics of the invention, which are excellent. Heat is quickly absorbed or dissipated, as required by the situation. If the tuning barrel has become overheated or too cold, heat dissipates or is absorbed quickly during use. Quick heat dissipation also prevents any extent of overheating by virtue of the warm breath of the musician.

While applicant does not want to be bound by any theoretical considerations, it is believed that the grooving provides greatly improved heat transfer during use of the clarinet. The configuration allows quick adjustment to thermal variations. Thus, substantially constant intonation is maintained in all temperature conditions.

The advantages of the clarinet tuning barrel of this invention are many. Replacement of a standard clarinet tuning barrel with the improved tuning barrel of this invention can have a significant positive effect on the overall performance of the clarinet on which it is used, whether it is a relatively expensive professional-grade clarinet or a relatively inexpensive student clarinet. Use of the tuning barrel of this invention assists the basic performance quality of student clarinets. Excellent intonation is more reliably produced, and various common problems are eliminated or substantially reduced.

DETAILED DESCRIPTIONS OF PREFERRED EMBODIMENTS

Figure 1:
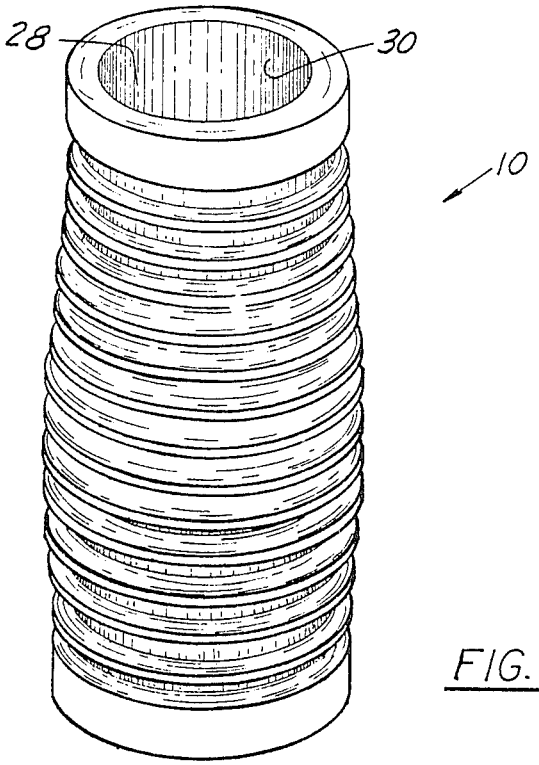
FIG. 1 is perspective view of a clarinet tuning barrel in accordance with this invention.
Figure 3:
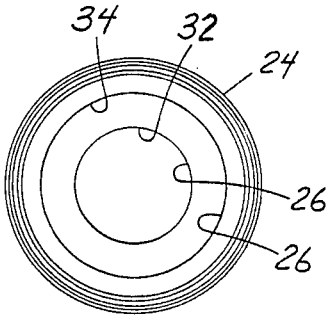
FIG. 3 is a left side view of FIG. 2.
Figure 2:
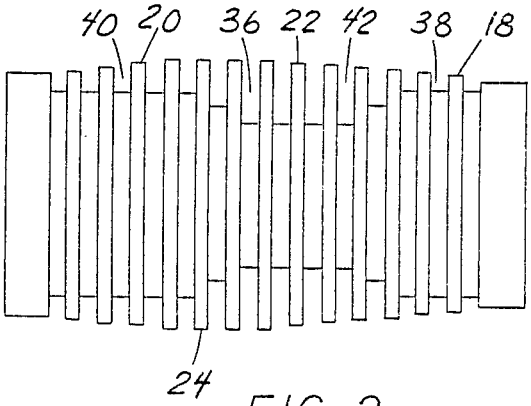
FIG. 2 is a reduced side elevation, in prone position.
Figure 5:
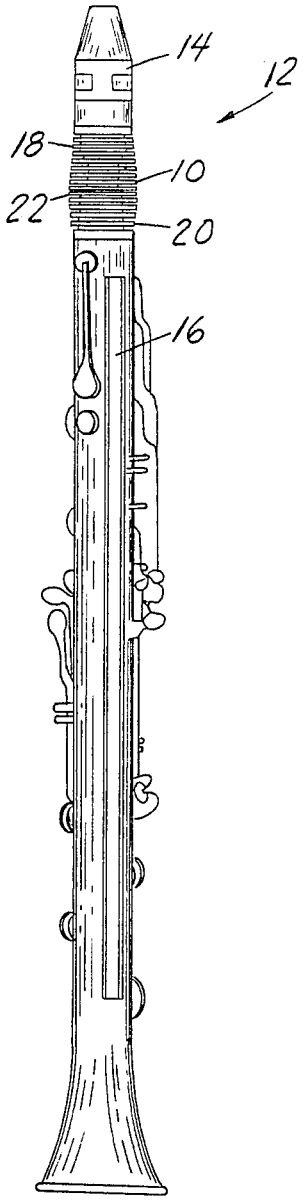
FIG. 5 is a side elevation of a clarinet having the clarinet tuning barrel of FIGS. 1–4.
Figure 4:
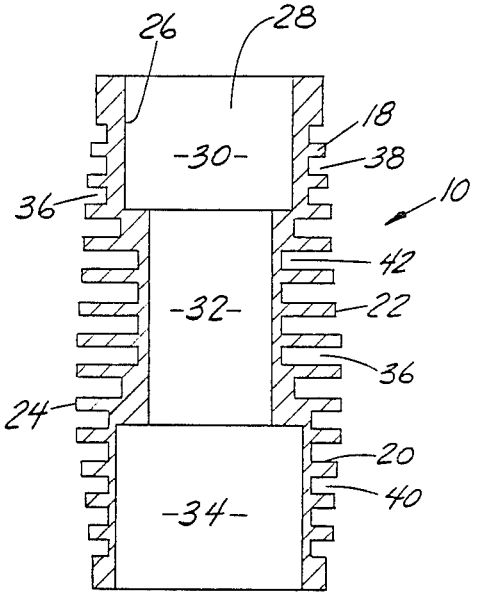
FIG. 4 is a side sectional view.

The figures illustrate an improved clarinet tuning barrel 10 in accordance with this invention. As shown in FIG. 5, tuning barrel 10 forms a part of a clarinet 12, the other major portions of which include a mouthpiece 14 and a clarinet body 16.

Tuning barrel 10 is an integral (unitary) thermally-conductive metal piece including an upper end portion 18, a lower end portion 20, and a central portion 22 between upper and lower end portions 18 and 20. Tuning barrel 10 has an outer wall 24 and an inner wall 26. Inner wall 26 defines a bore 28 aligned with the axis of tuning barrel 10 and extending completely through tuning barrel 10.

Bore 28 includes upper, central and lower cylindrical bores 30, 32 and 34, respectively, in series. Central bore 32 has a diameter less than the diameters of upper and lower bores 30 and 34. Upper and lower bores 30 and 34 are larger to receive male portions (not shown) of mouthpiece and clarinet body 16, respectively, in relatively tight but adjustable frictional engagement, as is well known. The diameter of central bore 32, near its opposite ends, is ideally substantially equal to the inner diameters of the aforementioned male parts (through which air flows) such that unnecessary air turbulence is avoided.

Bore 28, particularly central bore 32, is machined and polished to eliminate any bore imperfections which could have a deleterious effect on clarinet tone. Such excellent bore characteristics can readily be maintained for a great many years because of the nature of the material used for tuning barrel 10.

Outer wall 24 is somewhat barrel-shaped, that is, in lateral profile the outer wall is outwardly convex. The thickness of outer wall 24 is substantially greater along central portion 22 than it is along upper and lower end portions 18 and 20 of tuning barrel 10. This is due in part to the smaller diameter of central bore 32 and to the aforementioned convex profile.

Outer wall 24 has a plurality of grooves 36 in it, such grooving extending on upper end portion 18, central portion 22, and lower end portion 20 of tuning barrel 10. The grooving is such that it is a dominant feature of outer wall 24. Grooves 36 include grooves 38 on upper end portion 18, grooves 40 on lower end portion 20, and grooves 42 on central portion 22.

Grooves 36 extend around tubular tuning barrel 10, each of them being annular and parallel to one another. Grooves 36 are substantially equally spaced in an axial direction, and the spacing between adjacent grooves approximates the widths of each of the grooves.

The depth of each groove 36 is constant at all points around tuning barrel 10, but the various grooves 36 have different depths. Along all three portions 18, 20 and 22 of tuning barrel 10, grooves 36 have depths substantially greater than half the thickness of the tuning barrel wall adjacent to such grooves. Some or all of grooves 42, which are along central portion 22, extend radially inwardly to radial positions past (radially inside of) the radial position of inner wall 26 along upper and lower bores 30 and 34. Such deep grooving along substantially the entire length of tuning barrel 10 contributes to its desirable functional characteristics, including its light weight and its heat transfer characteristics.

Tuning barrel 10 is made of a thermally-conductive material. More specifically, the material forming tuning barrel 10 is an alloy having aluminum as its primary constituent. Such alloy has one or more other metals with densities much greater than the density of aluminum. Such alloy preferably has more than a total of about 5% of such other metals, most preferably including about 5% copper.

One of the most highly preferred embodiments of this invention is made of an aluminum alloy having about 93.5% aluminum, about 5.5% copper, about 0.5% lead, and about 0.5% bismuth. As noted above, it has been found that using alloys of the type described provide substantially improved tonal quality in the clarinet. In addition, such alloys have excellent corrosion resistance, which greatly extends the useful life of such tuning barrels.

Various surface treatments, such as anodizing and polishing contribute to the pleasing appearance of tuning barrel 10 without changing its functional characteristics. Anodizing may be used to protect and darken the relatively inaccessible walls of grooves 36, while polishing the more accessible outer portions between grooves brightens the appearance of outer wall 24.

Other metallic materials can be used in place of the preferred materials. Lightweight materials for which suitable tonal qualities are demonstrated are preferred.

While the principles of this invention have been described in connection with specific embodiments, it should be understood clearly that these descriptions are made only by way of example and are not intended to limit the scope of the invention.

What is claimed:

1. In a clarinet tuning barrel of the type having upper and lower end portions joinable to a mouthpiece and a clarinet body, respectively, a central portion therebetween, and inner and outer walls, the improvemtn comprising a thermally-conductive tubular member having a plurality of grooves in the outer wall, the grooves extending to depths exceeding about half the wall thickness of the tubular member adjacent to the grooves and having widths sufficient for air flow to the full depths of the grooves.

2. The clarinet tuning barrel of claim 1 wherein the upper, central and lower portions of the tuning barrel have said grooves.

3. The clarinet tuning barrel of claim 2 wherein the grooves extend around the tubular member.

4. The clarinet tuning barrel of claim 3 wherein the grooves are annular.

5. The clarinet tuning barrel of claim 4 wherein the annular grooves are parallel.

6. The clarinet tuning barrel of claim 5 wherein the annular grooves are substantially equally spaced.

7. The clarinet tuning barrel of claim 6 wherein the spacing between grooves approximates the widths of the grooves.

8. The clarinet tuning barrel of claim 2 wherein the inner wall along the upper, central and lower portions forms upper, central and lower cylindrical bores, the central bore having a diameter less than the diameters of the upper and lower bores and the grooves along the central portion extending radially inwardly to positions past the inner wall along the upper and lower bores.

9. The clarinet tuning barrel of claim 1 wherein the tuning barrel is an integral piece of thermally-conductive material.

10. The clarinet tuning barrel of claim 9 wherein the material is an alloy having aluminum as its primary constituent, whereby the tuning barrel has a light weight approximating the weight of a standard tuning barrel.

11. The clarinet tuning barrel of claim 10 wherein the alloy includes one or more other metals having densities substantially greater than that of aluminum.

12. The clarinet tuning barrel of claim 11 wherein the alloy includes at least about 5% of said other metals.

13. The clarinet tuning barrel of claim 12 wherein the inner wall along the upper, central and lower portions forms upper, central and lower cylindrical bores, the central bore having a diameter less than the diameters of the upper and lower bores and the grooves along the central portion extending radially inwardly to positions past the inner wall along the upper and lower bores.

14. The clarinet tuning barrel of claim 12 wherein the alloy includes about 5% copper.

15. The clarinet tuning barrel of claim 12 wherein the upper, central and lower portions of the tuning barrel have said grooves, said grooves are annular and extend around the tubular member.

16. The clarinet tuning barrel of claim 15 wherein the annular grooves are parallel.

17. The clarient tuning barrel of claim 16 wherein the annular grooves are substantially equally spaced.

18. The clarinet tuning barrel of claim 17 wherein the spacing between grooves approximates the widths of the grooves.

* * * * *